United States Patent [19]

Teixeira

[11] Patent Number: 4,756,417

[45] Date of Patent: Jul. 12, 1988

[54] PRODUCE BIN

[75] Inventor: Norman J. Teixeira, Santa Maria, Calif.

[73] Assignee: Teixeira Farms, Inc., Santa Maria, Calif.

[21] Appl. No.: 54,017

[22] Filed: May 26, 1987

[51] Int. Cl.[4] ..... B65D 21/02; B65D 90/16

[52] U.S. Cl. ..... 206/386; 108/55.1; 206/509; 206/512; 206/524.3; 426/106

[58] Field of Search ..... 40/208; 108/51.1, 51.3, 108/53.1, 53.3, 53.5, 55.1; 206/386, 509, 511, 512, 595-600, 524.3; 220/72; 426/106

[56] References Cited

U.S. PATENT DOCUMENTS

| | | | |
|---|---|---|---|
| 3,395,823 | 8/1968 | Langston | 206/511 |
| 3,502,237 | 3/1970 | Verhein et al. | 206/598 |
| 3,545,641 | 12/1970 | Olson | 206/511 |
| 3,828,964 | 8/1974 | Bonnot | 206/600 |
| 3,877,786 | 4/1975 | Booras et al. | 40/208 |
| 4,368,674 | 1/1983 | Wiens et al. | 220/72 |

FOREIGN PATENT DOCUMENTS

| | | | |
|---|---|---|---|
| 0028300 | 3/1977 | Japan | 206/509 |

*Primary Examiner*—Jimmy G. Foster
*Attorney, Agent, or Firm*—Daniel C. McKown

[57] ABSTRACT

A bin for storing and transporting produce includes a bottom, two side walls, and two end walls. The walls and bottom consist of corrugated paperboard that has been reinforced at strategic locations with strips of wood that are stapled to the corrugated board and that are then coated with a resin that includes glass fibers. When the resin has cured, the resulting structure is extremely durable and strong. A white colorant is added to the resin coating to impart a sanitary appearance to it. The bins can be stacked; and because the pallet of a stacked bin fits partly within the bin on which it rests and partly overhangs the bin on which it rests, the pallets may be stacked with considerable safety.

4 Claims, 4 Drawing Sheets

FIG. 8
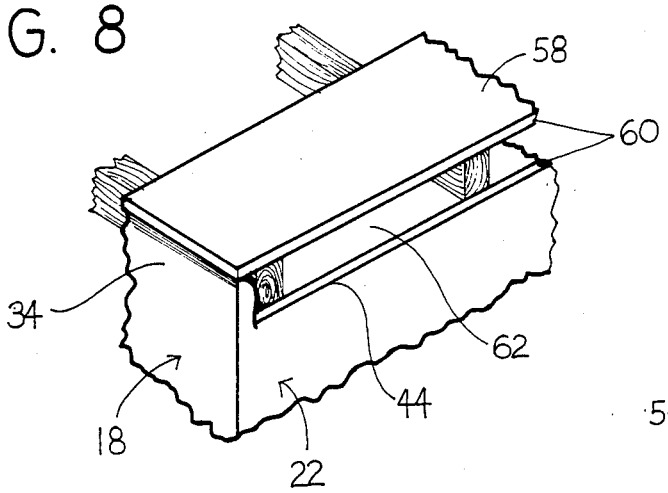
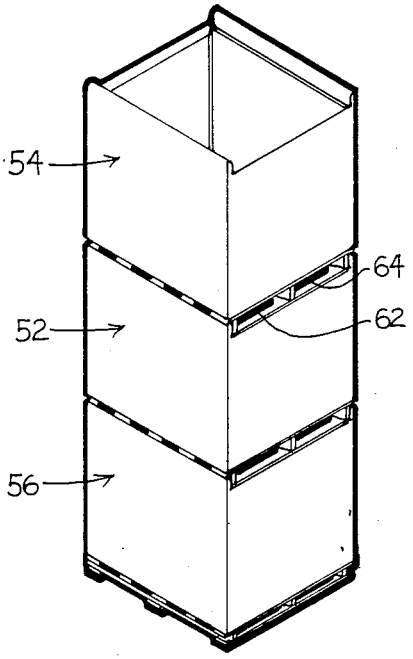
FIG. 7
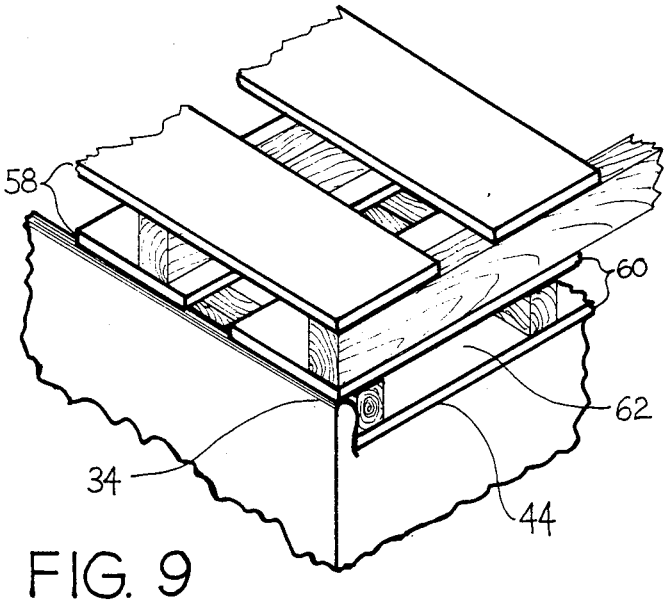
FIG. 9

PRODUCE BIN

BACKGROUND OF THE INVENTION

1. Field of the Invention

The present invention is in the filed of receptacles and more specifically relates to a bin for shipping and storing produce. Typically, the 50 cubic foot bins are loaded with 1,500 pounds of lettuce or other vegetables and are then shipped on trucks across the country to a point of use or further distribution. After they have been emptied, the bins are returned to the grower.

2. The Prior Art

Although many different types of bins have been patented through the years, it is believed that the present invention can be distinguished from earlier bins in at least three ways: the material of which the bin is formed, the process for manufacturing the bin, and the structure of the bin.

In U.S. Pat. No. 4,280,640, Daloisio shows an integral double-wall container of about the same size and shape as the present invention. However, the bin of Daloisio includes a double wall of polyethylene within which it is included a urethane foam. The bin is made by a rotational molding process.

In U.S. Pat. No. 3,616,010, Dunholter, et al. show a method for manufacturing a type of corrugated board, in which thermoplastic film is included in one wall of the corrugated board to render it moisture-proof.

In U.S. Pat. No. 4,383,609, Lochmiller shows a multipiece container that locks together. A sheet of cardboard extends under the top planks of a pallet. The box includes a lid, and the pallet of an upper box in a stack rests on the lid of the box immediately below it.

In U.S. Pat. No. 4,445,614, Mitsumori, et al. show a pallet formed of corrugated board and onto which a bottomless corrugated fiberboard container is placed, so that the top of the cardboard pallet serves as the bottom of the box.

In U.S. Pat. No. 4,165,806, Cayton shows a pallet to which compression-resistant vertical members are attached.

In U.S. Pat. No. 1,101,479, Van Osdel shows a cardboard box that has lips that extend upward from the walls at opposite ends of the box. Extensions extend downwardly from the bottom of the box and bear against the outside of the lips to steady the boxes when they are stacked. Similar structures are shown in U.S. Pat. Nos. 3,355,054 to Wilson and 4,175,691 to Cornell, et al.

None of the above patents shows the advantageous combination of features used in the present invention.

SUMMARY OF THE INVENTION

The features of the produce bin of the present invention make it attractive to owners and users alike.

The bin appeals to the manufacturer because it is simple to make and uses only readily-available materials and equipment.

It appeals to the vegetable grower, who is typically the owner, because it is unaffected by moisture, and is exceptionally strong and durable. Accordingly, unlike certain bins used in the prior art, the bin of the present invention is reuseable, and this feature is a powerful economic advantage.

The bin appeals to the shipper because of the ease with which it may be handled and stored. The bin is safely fork-liftable, and safely stackable, thereby reducing accidents and injuries.

Finally, the bin appeals to the buyer of the vegetables because it has a sanitary porcelin-like appearance. Its smooth finish resists staining, and normally the bin is easily cleaned by flushing it with water.

A prototype bin has withstood a 20,000 pound vertical test load, which is totally unexpected in view of the fact that the bin is composed primarily of corrugated cardboard.

The enormous strength and durability of the bin results mainly from two design features. First, a minimal amount of wood is used to strengthen the bin at strategic locations. Secondly, the corrugated board which forms the floor and walls of the bin, is coated with a resin in which glass fibers are included. This increases the strength of the corrugated board many fold.

In accordance with a preferred embodiment of the present invention, two end walls and two side walls extend vertically upward from a rectangular bottom. A wooden reinforcing member extends horizontally along the upper edge of each side wall. The end walls include similar horizontally-extending wooden reinforcing members along their upper edges, and further include vertically extending corner posts along the side edges of the end walls. These strategically-located members are effective in distributing and conducting the downward loads when the bins are stacked. The vertically-extending posts conduct the loads to a pallet to which the bottom is attached.

In accordance with the preferred embodiment, the side walls are taller than the end walls, so that the upper portions of the side walls constitute upwardly extending lips between which the pallet of a stacked identical bin fits to prevent the upper bin from sliding sideways with respect to the lower bin. The planks that form the upper part of the pallet extend below the spacers and planks that form the lower part of the pallet. The overhanging portion of the planks of the upper part of the pallet rests on the upper edges of the side walls when the bins are stacked, so as to distribute some of the weight to the horizontal reinforcing members of the sides. The pallet is sufficiently long that its lower portion at each end bears against the upper edges of the end walls. This distributes some of the weight to the horizontal reinforcing members that extend along the upper edges of the end walls.

In accordance with the preferred embodiment of the invention, the bottom and the walls of the bin include sheets of corrugated board that has been coated with a resin that includes glass fibers. This treatment of the corrugated board renders it impervious to liquids and makes it many times stronger and more durable.

The novel features which are believed to be characteristic of the invention, both as to organization and method of operation, together with further objects and advantages thereof, will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

BRIEF DESCRIPTION OF THE DRAWINGS

FIG. 7 is a perspective view showing two bins stacked on a third bin;

FIG. 8 is a fractional perspective view showing how a stacked bin sits on the bin below it in a preferred embodiment; and, FIG. 9 is a fractional perspective view showing how a stacked bin sits on the bin below it in an alternative embodiment.

DETAILED DESCRIPTION OF THE PREFERRED EMBODIMENT

Figure 1:
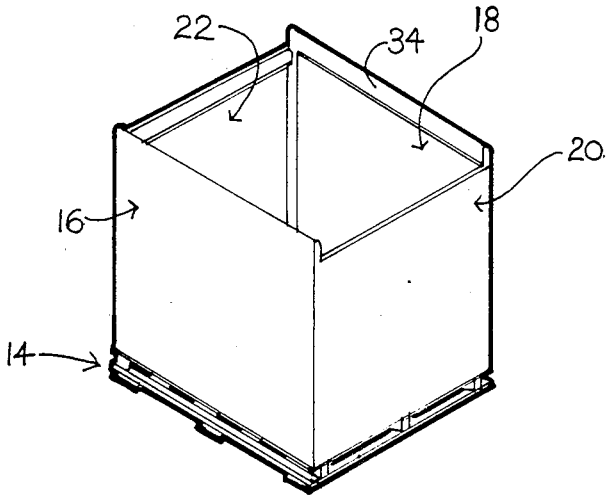
FIG. 1 is a front right and top perspective view of a preferred embodiment of the produce bin of the present invention.
Figure 2:
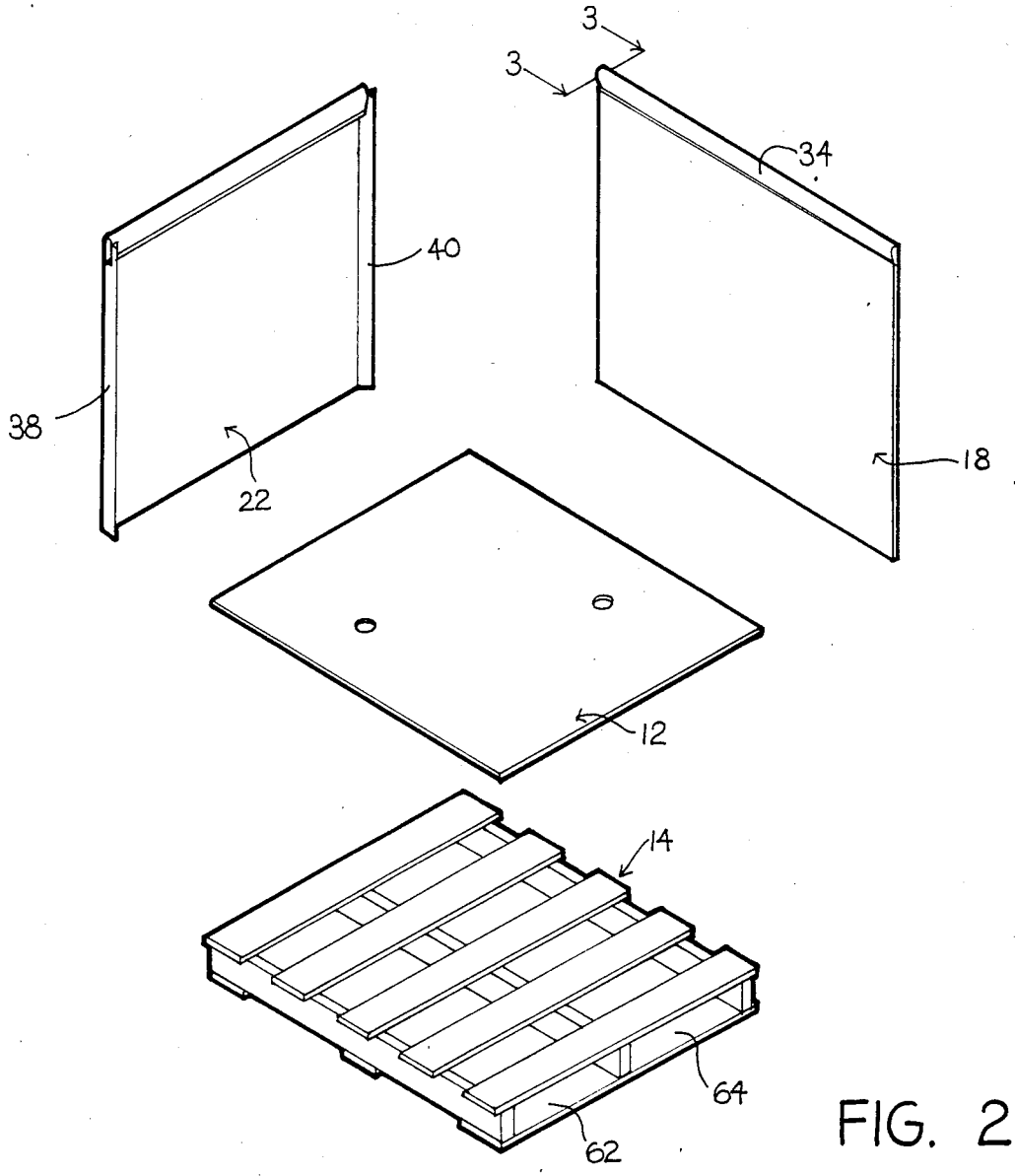
FIG. 2 is a fractional exploded view of the embodiment of FIG. 1, showing an end wall, a side wall, the bottom, and the pallet.

As best seen in FIGS. 1 and 2, in a preferred embodiment the produce bin includes a bottom 12 that is fastened to a pallet 14 by screws or other fasteners and further includes side walls 16, 18 and end walls 20, 22. These walls and the bottom 12 include sheets of corrugated paperboard reinforced at strategic locations by wooden reinforcing members, and coated with a generous coating of a resin including glass fibers. The structure of the produce bin is shown in greater detail in FIGS. 3–6.

Figure 3:
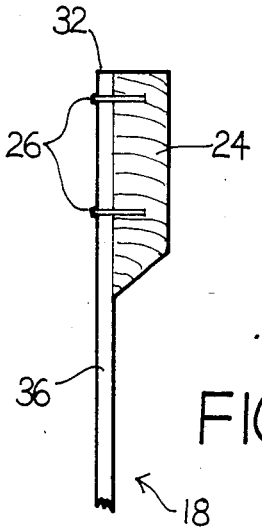
FIG. 3 is a fractional cross-sectional elevational view of a side wall in the direction 3—3 of FIG. 2.
Figure 4:
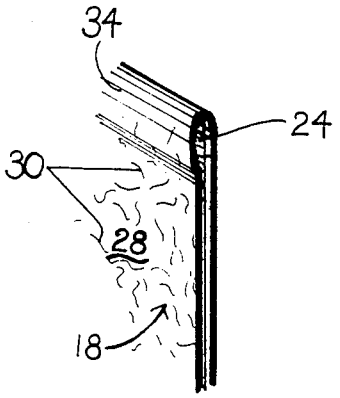
FIG. 4 is a fractional perspective view of the side wall of FIG. 3.

FIG. 3 shows the structure of the side wall 18 at an intermediate stage, while FIG. 4 shows the finished side wall 18. The side wall is formed by stapling a wooden reinforcing member 24 along the upper edge 32 of a large rectangular sheet 36 of corrugated paperboard. The use of the staples 26 has been found to be entirely satisfactory. It is preferable but not essential for the corrugations in the sheet 36 to extend in the vertical direction.

The intermediate structure of of FIG. 3 is then sprayed with a coating of liquid resin and short lengths of glass fibers 30 are distributed over the surface and then are covered by a further coating of resin, so that the glass fibers 30 are included within the resin coating. The coating is applied by the use of a "chopper gun," which is a well-known type of device. The finished side wall 18, bearing the coating 28 is shown in FIG. 4. The resin in the coating 28 cures in a matter of hours yielding a very durable and abrasion-resistant surface. The portion of the side wall 18 that includes the reinforcing member 24 will be referred to as the lip 34.

Figure 5:
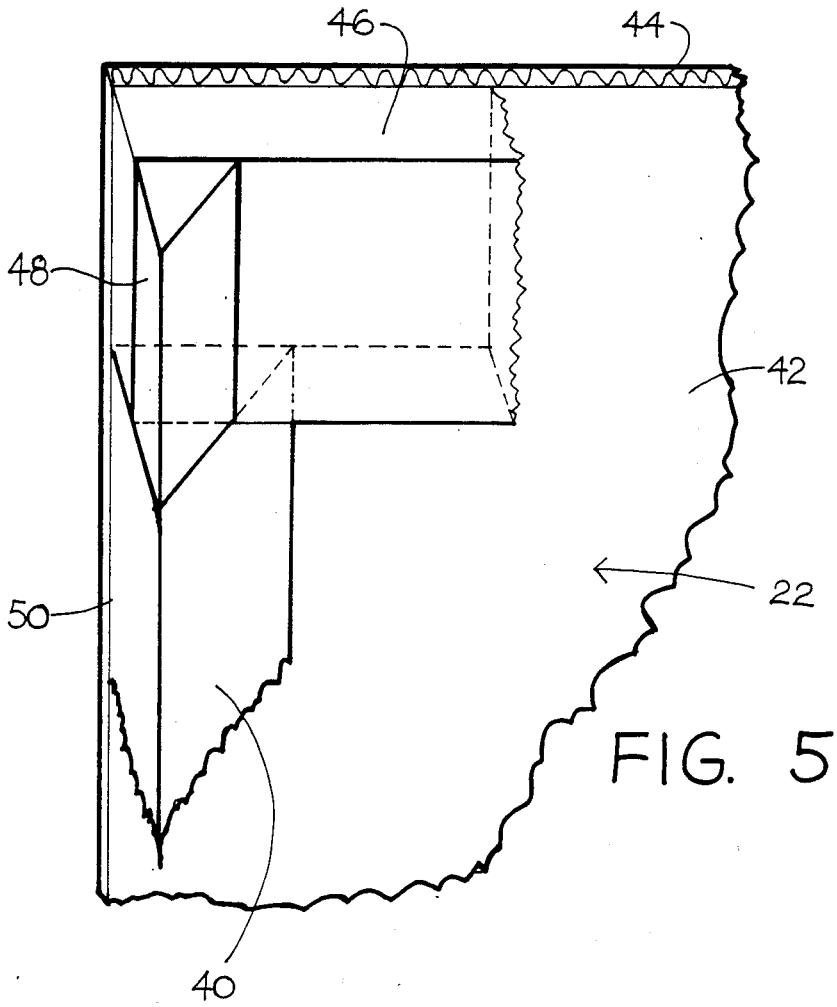
FIG. 5 is a fractional perspective view of an upper corner of an end wall.

FIG. 5 is a fractional view showing an upper corner of the end wall 22 at an intermediate stage of its fabrication. Corner posts 38, 40 are stapled to a large rectangular sheet 42 of corrugated paperboard which forms the core of the wall. It is desirable but not necessary that the corrugations extend in the vertical direction. The corner posts 38, 40 do not extend vertically to the upper edge 44 of the sheet 42, and a wooden reinforcing member 46 extends horizontally along the upper edge 44 and rests on the upper ends of the corner posts 38, 40. A short length 48 of triangular molding is bonded to both the corner post 38 and the reinforcing member 46 to strengthen the connection between them.

The intermediate structure of FIG. 5 is then coated with a coating of resin in which glass fibers are included, using the same resin and apparatus as was used for the side wall 18.

Figure 6:
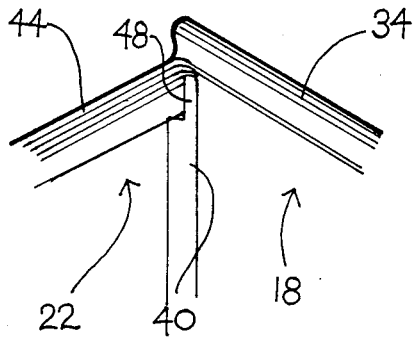
FIG. 6 is a fractional perspective view of a corner of the bin.

FIG. 6 shows the finished end wall 22 and how it is joined to the side wall 18. The surface 50 is bonded to the surface of the side wall 18, and the lip 34 rests on the reinforcing member 46 and the length 48 of molding. The lip 34 extends vertically above the upper edge 44 of the end wall 22.

In a similar manner, the other corners of the bin are formed. Thereafter, the entire exposed surface of the bin is given a resin coating, so as to render the bin moisture proof, and to strengthen the connection of the parts. A white colorant may be included in this final resin coating to impart a coating to the bin that looks sanitary and attractive. This white coating is especially desirable where the bin is to be used for transporting and storing food. The white coating tends to attract attention to any areas of it that are not clean, and this encourages thorough cleaning of the bins, thereby maintaining a high standard of sanitation.

FIG. 7 shows two identical bins 52, 54 stacked on a third bin 56. Especially noteworthy is the manner in which the pallet 14 of a stacked bin cooperates with the bin on which it is stacked to distribute the weight and to prevent the stack from tipping. The pallet 14 provides passages 62, 64 that extend lengthwise of the pallet and that accommodate the forks of a forklift when the bin is to be lifted. The details of the interaction between the pallet and the top of the bin below it are shown in greater detail in FIG. 8.

It is noteworthy that the passage 62 is surrounded by the wooden members of the pallet, and this is important for prolonging the life of the bin. Frequently, the forks of a forklift are not at precisely the optimum elevation, and as a result the forks strike or slide against the material adjacent the passage into which they are to be inserted. When the present invention is used, this results in no wear on the walls or bottom of the bin, because the pallet takes all of the abuse.

As shown in FIG. 8, the pallet includes an upper portion 58 which, in this case, consists of the planks that constitute the top of the pallet, and a lower part 60 which comprises the spacers which run lengthwise of the pallet and the planks that constitute the bottom of the pallet. The lower part 60 of the pallet is slightly less wide than the space between the side walls 16 and 18, so that the lower part 60 will fit between the lips 34 of the side walls when the pallets are stacked. On the other hand, the upper part 58 of the pallet is sufficiently wider to rest on the lips 34 of the sides 16, 18 when the pallets are stacked. The lower part 60 of the pallet is sufficiently long and deep to rest on the upper edges 44 of the end walls. Thus, some of the weight of the stacked bins is borne by the lips 34, and particularly by the reinforcing members 24, while the remainder of the weight is borne by the upper edges 44 of the end walls 20, 22, and more particularly by the reinforcing members 46. The reinforcing members 24 and 46 transfer the load to the corner posts 38, 40, which rest on the pallet 14. In this manner, the weight of the stacked bins is distributed more or less evenly, and the reinforcing members 24, 46 and the corner posts 38, 40 are used to fullest advantage. It is seen that although the resin-coated corrugated board of the walls of the bin is unexpectedly strudy, the stragically located reinforcing members insure that the walls are protected from the heavier loads. The stiffenness of the walls is important in preventing the corner posts from buckling.

When fully loaded, the bin may have a gross weight of 1,500 pounds, and it is contemplated that in practice at least two bins will be stacked on top of a third bin, thereby imposing on the third bin a load of 3,000 pounds. A prototype bin has withstood a downward load of 20,000 pounds, thereby implying a safety factor of 6.

FIG. 8 also shows that a stacked pallet cannot slip sidways off of the stack, because of the lip 34. Little harm is done if the stacked bin is misplaced in a direction parallel to the lip 34. In that case, although the pallet no longer bears on the upper edge 44 of the end wall, nevertheless, the upper part 58 of the pallet still remains in place on the lip 34 which is then more heavily loaded.

FIG. 9 shows a different pallet design that could be used if it became necessary to insert the forks of the forklift from the side of the stack as well as from the end. In effect, a second pallet is placed on top of the first pallet, and the passages of the second, upper, pallet extend across the bin, while the passages of the lower pallet extend lengthwise of the bin. In this embodiment, the lower part 60 of the pallet still fits between the lips 34 and the upper part 58 still rests on the lips 34. The bottom 12 of the bin would be attached to the top surface of the pallet of this embodiment.

It is also noteworthy that the stacking technique of the present invention provides ventilation to each bin in the stack through the pallet portion.

Thus, there has been described a produce bin of a uniquely simple and low cost construction. The bin is formed of readily-available materials and can be built with relatively simple and inexpensive equipment.

The present invention also comprehends the production of a structural material that consists of a sheet of corrugated cardboard to which a coating of resin that includes glass fibers has been applied. This particular combination is not only moisture proof but has proven to be unexpectedly strong and damage-resistant.

The foregoing detailed description is illustrative of one embodiment of the invention, and it is to be understood that additional embodiments thereof will be obvious to those skilled in the art. The embodiments described herein together with those additional embodiments are considered to be within the scope of the invention.

What is claimed is:

1. A bin suitable for transporting and storing produce or the like and particularly adapted to permit an identical bin to be stacked on it safely by the use of a fork lift, said bin comprising:

a pallet including an upper part and a lower part both of rectangular shape and having the same length but different widths, the width of the upper part exceeding the width of the lower part so that the upper part extends beyond the lower part on both sides, the lower part of said pallet including passages extending lengthwise of said pallet to accommodate the forks of a fork lift;

a bottom attached to and congruent with the upper part of said pallet, said bottom having opposite side edges and opposite end edges;

two side walls attached to opposite side edges of said bottom and extending upwardly therefrom to respective upper edges, said two side walls parallel to each other and spaced apart with the distance between them slightly greater than the width of the lower part of said pallet but less than the width of the upper part of said pallet, whereby the upper part of the pallet of an identical stacked bin will rest on the upper edges of said two side walls;

two end walls attached to opposite end edges of said bottom and extending upwardly therefrom to respective upper edges, said two end walls parallel to each other and spaced apart with the distance between them slightly less than the length of the lower part of said pallet, said two side walls extending higher than said end walls by an amount equal to the height of the lower part of said pallet, whereby the upward extensions of said two side walls beyond the height of the upper edges of said end walls constitute lips that abut the lower part of the pallet of an identical stacked bin to prevent sideward movement of the identical stacked bin, and whereby the opposite ends of the lower part of the pallet of an identical stacked bin will rest on the upper edges of said two end walls.

2. The bin of claim 1 wherein the upper part of said pallet includes passages extending crosswise of said pallet to accommodate the forks of a fork lift, whereby the forks may be inserted from an end of the bin or from a side of the bin.

3. The bin of claim 1 wherein the bottom, the two side walls, and the two end walls all include corrugated paperboard coated with a resin in which glass fibers are included.

4. The bin of claim 1 wherein each of said two side walls further includes a reinforcing member extending horizontally along its upper edge; wherein each of said two end walls further includes a reinforcing member extending horizontally along its upper edge and two corner posts extending vertically along its side edges; wherein the reinforcing members of said two side walls are supported at their ends by the reinforcing members of said two end walls; and wherein the reinforcing members of each of said two end walls rest on the two corner posts of the end wall, whereby downward loads on the upper edges of said side walls and said end walls, encountered when identical bins are stacked, are conducted to the corner posts, and from the corner posts to said pallet.

* * * * *